US007850249B2

(12) United States Patent
Manners

(10) Patent No.: US 7,850,249 B2
(45) Date of Patent: Dec. 14, 2010

(54) FLOOR COVERING REMOVAL MACHINE

(76) Inventor: Herbert C. Manners, 220 Manners La., Punxsutawney, PA (US) 15267

( * ) Notice: Subject to any disclaimer, the term of this patent is extended or adjusted under 35 U.S.C. 154(b) by 682 days.

(21) Appl. No.: 11/385,478

(22) Filed: Mar. 21, 2006

(65) Prior Publication Data

US 2007/0222274 A1 Sep. 27, 2007

(51) Int. Cl.
*B32B 38/10* (2006.01)

(52) U.S. Cl. ..... 299/36.1; 156/344; 156/584

(58) Field of Classification Search ..... 299/36.1, 299/37.1, 39.1, 39.2, 39.4, 40.1, 75; 81/45; 30/169, 170, 172; 15/93.1; 52/749.12; 156/344, 156/584

See application file for complete search history.

(56) References Cited

U.S. PATENT DOCUMENTS

| | | | |
|---|---|---|---|
| 2,655,976 | A | 10/1953 | Lovin |
| 4,332,371 | A | 6/1982 | Bell et al. |
| 4,906,323 | A | 3/1990 | Thomas |
| 4,948,451 | A | 8/1990 | Foltz |
| 5,387,308 | A | 2/1995 | Heavrin |
| 5,415,725 | A | 5/1995 | Scharf |
| 5,454,899 | A | 10/1995 | Glenn et al. |
| 5,456,794 | A | 10/1995 | Barrett |
| 5,720,844 | A | 2/1998 | Hanson |
| 5,830,313 | A | 11/1998 | Smith |
| 5,891,298 | A | 4/1999 | Kuroda et al. |
| 5,909,868 | A | 6/1999 | Galella |
| 6,004,426 | A | 12/1999 | Johnson |
| 6,113,075 | A | 9/2000 | McMichael et al. |
| 6,199,616 | B1 | 3/2001 | Gillespie |
| 6,371,401 | B1 | 4/2002 | Ketterer |
| 6,386,476 | B1 | 5/2002 | Aldeman, Jr. |
| 6,428,108 | B1 | 8/2002 | Chase |
| 6,595,261 | B2 | 7/2003 | Fitterer |
| 6,840,299 | B2 | 1/2005 | Allen et al. |

FOREIGN PATENT DOCUMENTS

SU 1710460 A1 * 2/1992

OTHER PUBLICATIONS

Internet article, "New Dura-Drive Plus",2001.*

(Continued)

*Primary Examiner*—Sunil Singh
(74) *Attorney, Agent, or Firm*—The Webb Law Firm

(57) ABSTRACT

A floor covering removal machine for removing a floor covering that is secured to a floor that includes a drive frame formed with an underside caster assembly, and feed, ejection, and oppositely arranged cutter sides. A variable speed, reversible, motorized drum is mounted about the frame and cooperates with a gripping idler roller that is releasably biased toward the drum to establish a grip interface which conveys the floor covering from the feed to the ejection sides. In operation, the floor covering is pulled through the grip interface and thereby removed from the floor. The machine also may include a collapsible guide handle extending from the drive frame and a motor speed control. Optional retractable floor covering cutters are included that are deployable in a floor contour-following configuration. An optional alignment laser pointer is mounted on the frame for alignment during operation.

20 Claims, 5 Drawing Sheets

OTHER PUBLICATIONS floorcovertools.com, Super Power Carpet Puller #444, http://www.floorcoveringtools.com/customer/product.php?productid=444&cat=&page=1, Jul. 27, 2005.

Eugen Lägler GmbH, Reno Floor Removing Machine, http://www.laegler.de/html_e/p_reno_te.htm.

Lorenzi, Neal, Flooring Removal Simplified, http://plantservices.com/Web_First/ps.nsf/ArticleID/NLOI-4RPUKY/, Mar. 19, 2004.

Sparks Belting Company, Dura Drive Plus Technical Manual, http://www.sparksbelting.com.

* cited by examiner

FLOOR COVERING REMOVAL MACHINE

BACKGROUND OF THE INVENTION

1. Field of the Invention

The invention advances that state of the art of removing floor coverings such as carpets that are glued or fastened to a floor surface.

2. Description of Related Art

Floor coverings have been in use for the duration of recorded history. In more recent centuries, floor coverings have become more durable, and more suitable for use in residential and commercial high-traffic pedestrian areas. Those skilled and knowledgeable in the related fields of technology have long understood that such high-traffic environments establish unfavorable wear conditions for carpeting and other types of floor coverings. Many problems have resulted and include accelerated wear and deterioration. This type of damage often may occur as a result of unwanted shifting of the floor covering during use due to the movement of individuals, furniture and equipment.

Attempts to reduce wear due to undesired shifting led to efforts to fasten the floor covering to the sub-floor. Fastening methods have included adhesive materials and mechanical fasteners. In more recent decades, advances in the state of the art of such fastening techniques have borne improved glues and improved nails, tacks, staples, and combinations thereof. These fastening methods have matured and now ensure very strong and permanent interfaces that join the floor covering to the subjacent floor surface.

Despite improvement in the wear and damage that results from better fastening methods, floor coverings still see wear and unavoidable deterioration over time, which necessitates removal and replacement. In some instances, the worn covering is covered over with a new floor covering, but such overlayments are only possible a limited number of times. The layered coverings create instability due to continued deterioration of the underlying and new covered materials, as well as the eventual disintegration of the adhesives typically applied in the interstices between the layers.

Eventually, all floor covering layers must be removed to expose the native sub-flooring or underlayment, so that a new floor covering can be installed. The capability to remove a floor covering that is secured to the sub-floor using newer fastening techniques has become more difficult with each advance in fastening technology. In turn, the ever increasing difficulty has led to the need for more capable removal methods and technologies.

In the last several decades, many attempts to improve the state of the art in removal methods have resulted in issuance of patents in the United States that illustrate some of the purported advances. Of the many improved techniques, devices, and equipment brought to bear on the problems associated with removing securely-fastened floor coverings, those endeavoring in the related arts have continually attempted to improve the capabilities of many types of automated machines and devices.

In one previous improvement related to removal of linoleum floor coverings, U.S. Pat. No. 2,655,976 to Lovin, incorporates a box-like frame that includes a heating device to heat the linoleum prior to removal. After heating, it is spooled onto a roll driven by the wheels mounted to the bottom of the box frame. The Lovin device requires that the linoleum is previously cut into strips and then heated before it can be removed from the floor surface.

Another previous attempt is described in U.S. Pat. No. 4,948,451 to Foltz and is limited to an automatic carpet stripping apparatus that includes a self-propelled carpet machine with a frame mounted pair of motorized rollers that receive a loose end of a carpet and then pull the carpet up off of its supporting surface. The Foltz device also describes a pair of knives arranged to cut the carpet into strips during removal.

U.S. Pat. No. 5,720,844 to Hanson describes another previous device that is similar to the Foltz machine. However, the Hanson machine incorporates in place of the rollers a compression gear with teeth that is driven by an opposing and confronting, toothed drive gear. The carpet is cut into strips by cutter assemblies having blades mounted on opposite sided skid plates such that the carpet is cut and pulled between the complex gear arrangement to be lifted and removed from the floor surface.

Another purported improvement is described in U.S. Pat. No. 6,004,426 to Johnson, which employs a driven spool member that captures an edge of the carpet and attempts to wind it over the spool to tear the carpet from the floor. For removing a carpet that has been pre-cut into strips, U.S. Pat. No. 6,371,401 to Ketterer describes a wheel frame that incorporates a rotating casing that must be fastened to an end of a carpet strip. The strip is then pulled from the floor surface and spooled onto the casing as the device rolls across the floor. The direction of the device is then reversed to unspool the carpet for subsequent removal from the casing.

U.S. Pat. No. 6,595,261 B2 to Fitterer describes an apparatus to remove a floor covering by separating the covering from the floor with a knife blade and then threading the floor covering through a series of three rollers to pull it away from and remove it from the floor surface.

The various prior art devices and machines that purport to reduce the amount of manual labor needed to remove a floor covering, such as a carpet from the floor surface, fail to overcome a number of disadvantages that persist for users who are confronted with removing floor coverings. In one respect, most prior art machines remain unwieldy and of such a large size that prevents their use in narrow hallways and other confined spaces. Additionally, the larger profile machines can be expensive as a result of the many moving parts and complex components that are needed to manufacture and operate the assemblies. Further, the more complex machines are more expensive to buy and maintain as a result of such complexity. Other shortcomings that persist include an undesirable amount of noise and dust that results from the overly large size and complexity of many of such devices. As previous attempts have increased the size and complexity of the floor covering removal machines, other attempts have endeavored to reduce the size and weight. Even so, the devices offered by Ketterer and Johnson, while directed to reducing complexity and weight, have introduced other disadvantages such as less power and pulling forces.

These prior attempts describe different devices that each seek to improve the state of the art, however, in the field of removing floor coverings, such as carpeting and the like, many challenges remain despite the previous innovations. The smaller machines that have been devised remain difficult and slow to use for removal of floor coverings that are very securely fastened to a floor surface. Larger more powerful machines remain bulky, unwieldy and too large to maneuver into confined areas, and too heavy to enable easy transport to and from locations. Such larger machines are also more complex and require more frequent servicing of the many moving parts.

Further, most of such larger machines create a substantial amount of dust during the removal operation, and remain too noisy for use in many residential, commercial, and industrial settings and applications. As a result, the use of such larger machines is limited to off hours when increased dust and high volume sound will not interfere with other regular activities on the premises.

Additionally, many, if not all such machines, including those described above, inject new problems to the difficulties in the lifting and removing operations. Mainly, the prior, more powerful machines most often operate at speeds and with forces that tend to rend the floor covering during removal, which occurs often and especially on start-up of the machine. Such rending results in more dust and produces shredded material and debris that fouls the machines, which requires frequent stops and starts to clean and reset the machine. Attempts to lessen the rending of the floor covering during removal have resulted in even more complex mechanisms or inadequate pulling and lifting capabilities.

What has been needed and heretofore unavailable is a floor covering removal machine that is small in overall size and profile and that minimizes weight for easy transportation to and from job sites. More preferably, an improved machine is needed that is quiet to operate, that minimizes unnecessary rending and dust and debris, and which has a minimum of moving parts to lessen complexity, reduce maintenance costs, and which further increases the ease of operation. Even more preferably, it is desirable to have a machine that offers these benefits while enabling any desired speed and power setting so that floor coverings can be removed quickly and with a minimum inconvenience to the operator.

SUMMARY OF THE INVENTION

The floor covering removal machine according to the present invention overcomes the many shortcomings of the prior attempts in new and innovative ways that offer substantial advantages heretofore unavailable. In one of the preferred embodiments of the invention, a floor covering removable machine includes a drive frame that is formed with an underside caster assembly and a feed side that is opposite an ejection side, and with at least one cutter side therebetween. A guide handle extends from the drive frame for maneuvering the removal machine during operation. A control assembly is also included and coacts with the drive frame and further includes a motor speed control.

The drive frame preferably also includes at least one retractable floor covering cutter that is deployable from the at least one cutter side in a contour following relationship with the floor surface for cutting the floor covering. The removal machine also includes at least one motorized drum that is preferably carried from the drive frame, and which is in electrical communication with the motor speed control. Also, at least one releasable idler roller rotationally coactive with the at least one motorized drum to establish a grip interface therebetween. The at least one idler roller more preferably counter rotates relative to the at least one motorized drum.

In operation, the floor covering is preferably received across the grip interface between the at least one motorized drum and at least one idler roller while being conveyed from the feed side to the ejection side. Further, the motorized drum preferably includes an outer housing that is rotationally driven by an entirely internal motor and gear train assembly that is mounted on a shaft fixed to the drive frame.

Additionally, the motor speed control may also preferably incorporate a reverse, a constant, and an adjustable speed selector as well as a delay circuit. More preferably, the delay circuit will be variable to gradually start the motorized drum and reach the full selected speed setting, and will also gradually slow down or stop the motorized drum on actuation of one of the limit switches or the selector of the motor speed control.

The floor covering removal machine also further preferably includes a release arm mounted to the drive frame and connected to the at least one idler roller to be movable to an unclamped position that separates the at least one idler roller and or moves it away from the motorized drum. Also, a biasing element such as a grip spring may be mounted to the drive frame to bias and urge the at least one idler roller toward and or against the at least one motorized drum. The release arm in operation compresses the biasing element or grip spring to separate the idler roller or move the roller away from the at least one motorized drum. More preferably, a mechanical or electrical release lever is also mounted about the removal machine and is connected to the release arm to mechanically or electrically actuate the release arm.

In other variations of any of the embodiments of the invention, the floor covering removal machine also preferably includes an optional contour bias element or spring arranged about the at least one cutter to urge the cutter toward the deployed position and toward or against the floor surface in a contour following relationship. A retractor may also be mounted about the removal machine and more preferably about the guide handle that is connected to the at least one cutter to mechanically or electrically deploy and retract the at least one cutter.

The various embodiments of the invention also contemplate at least one scraper or separator bar that is positioned against either the at least one motorized drum and or the at least one idler roller, or both, to separate floor covering material and debris from the drum and the roller. More preferably, the scraper is carried beneath the drive frame and urged toward and or against the at least one of the motorized drum or the idler roller close to an ejection side of the grip interface. The scraper or separator bar may preferably be fixed or movable and further include a sharp blade and or knife edge that is urged against the at least one motorized drum and or the at least one idler roller to scrap away the floor covering as well as any debris, adhesives, or other material that would otherwise adhere to and likely foul the drum or the roller.

Additional variations of the innovative features of the invention also contemplate at least one actuatable cutoff or limit switch that may be carried from the removal machine, and which is in electrical communication with the motor speed control. More preferably, the at least one cutoff or limit switch is carried from the feed side of the drive frame and extends in a forward direction so that as the drive frame approaches a wall or other obstacle rising up from the floor surface, the limit switch actuates to stop the motorized drum.

The preferred embodiments of the invention may also be further modified to include a laser alignment guide that may be mounted to the drive frame about at least one alignment side thereof. The at least one alignment side may be the at least one cutter side. The laser alignment guide preferably incorporates at least one projected alignment beam that illuminates a preferred path of the floor covering removal machine or that lines up with any desired alignment target.

The removal machine may also further incorporate one or more or a plurality of side rollers that can be mounted to the drive frame in a number of locations, including about opposite extents of the feed side and or ejection side of the drive frame. Preferably, the side rollers rotate about a generally vertical axis and extend slightly outside the profile of the drive frame to prevent abrasion of the walls or the other appurtenances extending about the floor surface, and to guide the removal machine along a contour of a wall.

The floor covering removal machine of the present invention offers these many benefits, as well as other advantages over the prior attempts with new and innovative devices and methods. Those having knowledge in the relevant fields of technology can more fully comprehend the aspects of the present invention with reference to the following drawings and illustrations in connection with the detailed description of the various embodiments of the invention.

DESCRIPTION OF THE PREFERRED EMBODIMENTS

Figure 1:
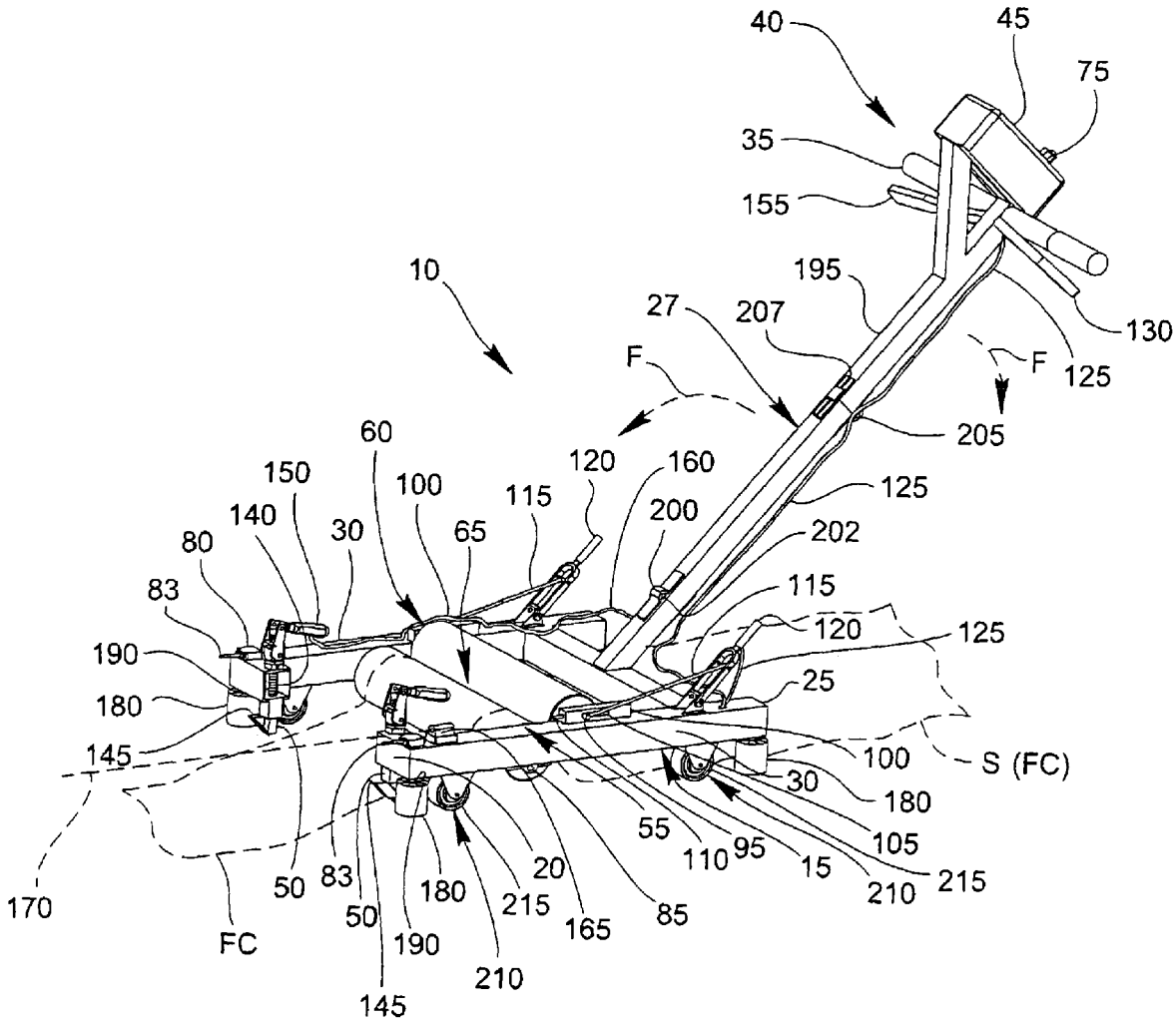
FIG. 1 is a top perspective view of a floor covering removal machine made in accordance with the present invention.
Figure 2:
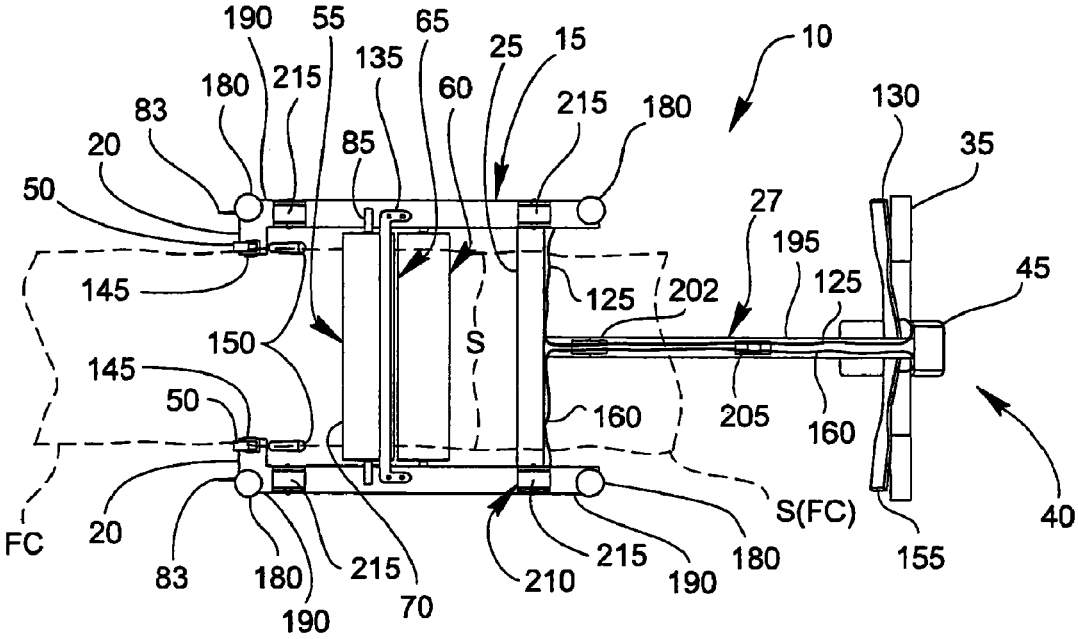
FIG. 2 is an underside plan view of the floor covering removal machine of FIG. 1 with certain structure removed for illustration purposes.
Figure 3:
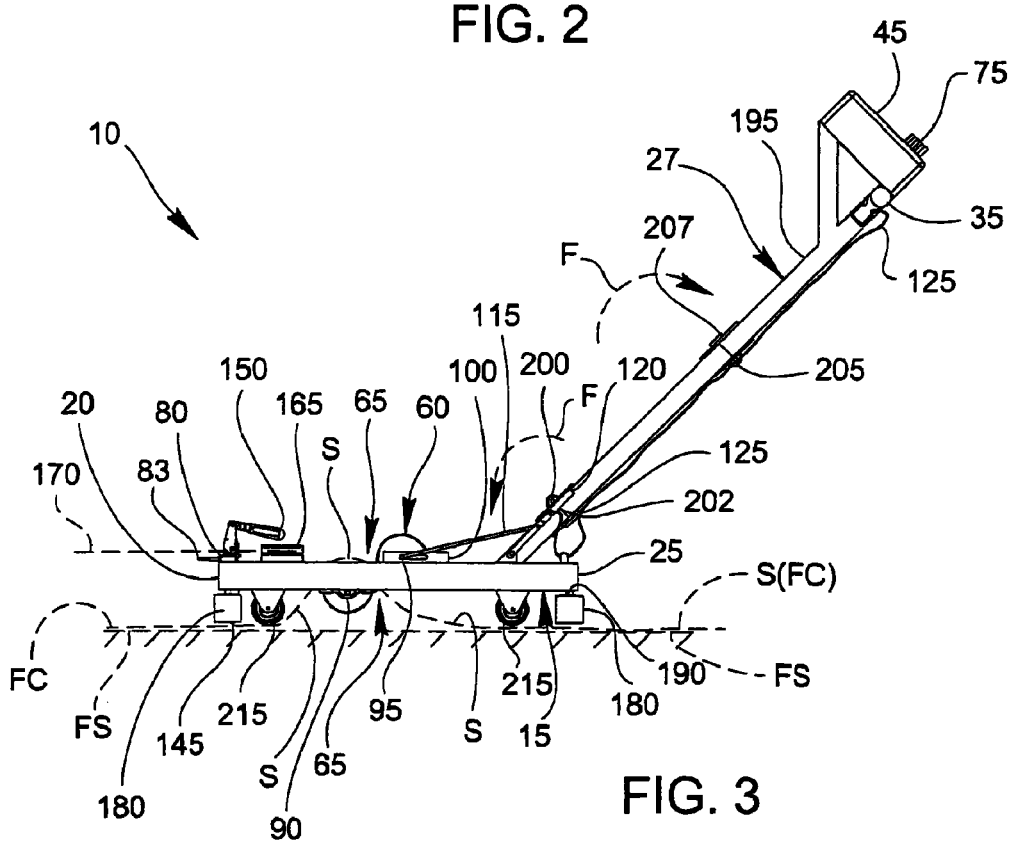
FIG. 3 is a side elevation view of the apparatus of FIGS. 1 and 2.

With reference now also to FIGS. 1 through 3, an embodiment of the inventive floor covering removal machine 10 is shown to include a drive frame 15 having a generally forward feed side 20, an opposite ejection side 25, and at least one cutter side 30. A folding extension 27 projects from the drive frame 15 and carries about a distal end a guide handle 35 positioned to maneuver the floor covering removal machine 10 during operation. Further, a control assembly 40 may also be included and may have a motor speed control 45 that together coact with the drive frame. As seen in FIGS. 1-3, the motor speed control 45 may be carried about the guide handle 35. The floor covering removal machine 10 preferably incorporates an optionally preferred at least one retractable floor covering cutter 50 that is deployable beneath the drive frame 15 and carried from the at least one cutter side 30.

The drive frame 15 also preferably includes at least one motorized drum 55 that is carried from the frame 15 and which is in electrical communication with the motor speed control 45. Additionally, at least one releasable idler roller 60 is incorporated and is positioned to cooperate with and or to coact in a counter-rotating relationship with the at least one motorized drum 55. As a result of such rotationally gripping and clamping coaction and or contact, the idler roller 60 and the motorized drum 55 thereby establish a gripping interface 65 therebetween. The gripping interface 65 receives a floor covering FC as it is conveyed from the feed side 20 across the grip interface 65, and toward the ejection side 25.

Preferably, the floor covering FC may be any type of sheet material that is laid upon a floor surface FS (FIG. 3), and which is fastened thereto with mechanical fasteners, glue, or other adhesives. Such floor coverings FC more preferably include vinyl floor coverings, linoleum, and other types of polymeric floor coverings.

Even more preferably, the floor covering removal machine 10 is optimized for lifting and removing strips and sections S of the floor covering FC (FIGS. 1-3) such as carpeting and similar materials. Floor coverings FC such as carpeting can present special challenges in that carpeting materials may be rended and create unnecessary dust and debris when removed with prior art devices. As further described here and below, the present floor covering removal machine 10 introduces new capabilities and advantages over the prior art, and may be used with carpeting in ways that minimizes such rending and dust or debris.

With reference now also to FIGS. 4-7, and for purposes of illustration but not for purposes of limitation, one possibly suitable idler roller 60 may be adapted from a large diameter conveyor roller that is available from Sparks Belting Company of Grand Rapids, Mich. The at least one motorized drum 55 is also referred to by those having skill in the art as a motorized pulley, a conveyor pulley, and or roller. The motorized drum or pulley 55 includes a rotating outer housing 70 that is controlled by a speed selector 75 that is included with the motor speed control 45, which is adapted to enable a reverse speed, a constant speed and an adjustable speed setting on the selector 75.

This speed adjuster capability of the floor covering removal machine 10, enables a corresponding adjustment and the force imparted by the motorized or torque drum 55 as the floor covering FC is pulled up and removed from the floor surface. In other words, adjustment of the speed of the motorized or torque drum 55 creates the capability to optimize the force imparted on the floor covering FC to minimize rending of the material of the floor covering FC during the removal operation.

Further preferred modifications of the floor covering removal machine 10 also may be directed to modifications of the motor speed control 45 to have an alternating current frequency controller that may be adapted to accept and to change one-hundred fifteen volt single phase current, which is the most commonly available power source, to output a two-hundred thirty volt three phase current, which is most commonly required by various motorized drums 55 currently available on the market.

The motor speed control 45 may preferably also include an optional delay circuit that is configured to gradually ramp up the speed of the motorized drum 55 when rotation is started. The speed is gradually increased by the delay circuit so that the speed of the motorized drum 55 smoothly changes from one speed setting to the next. Similarly, the delay circuit preferably gradually adjusts the speed of the motorized drum 55 when the speed is reduced and when the drum is stopped.

In this way, the delay circuit limits the amounts of power consumed by the motorized drum 55 to limit the instantaneous current draw, which can minimize or eliminate current and voltage transients and spikes. The gradual speed change capabilities of the delay circuit thereby protect the motorized drum 55 and its constituent components as well as the other components of the floor covering removal machine 10. Additional benefits that result from this delay circuit feature include smooth starting and stopping operations, reduced mechanical wear on the removal machine 10, and the minimization of rending of the floor covering FC materials during lifting and removal operations.

Variations of the present invention may also incorporate at least one actuatable limit switch 80 that may be mounted on the drive frame and, more preferably, carried from the feed side 20. More preferably, the at least one actuatable limit switch or cutoff switch 80 is in electrical communication with the motor speed control 45 to interrupt the rotation of and stop the at least one motorized drum 55 upon actuation of the cutoff or limit switch 80. Also, a plunger 83 protrudes and extends a distance from the front of the limit switch 80 and the feed side 20. The plunger 83 contacts the wall or other upwardly projecting obstacle, object, obstruction, or appurtenance to actuate the limit switch 80 and stops operation.

Figure 6:
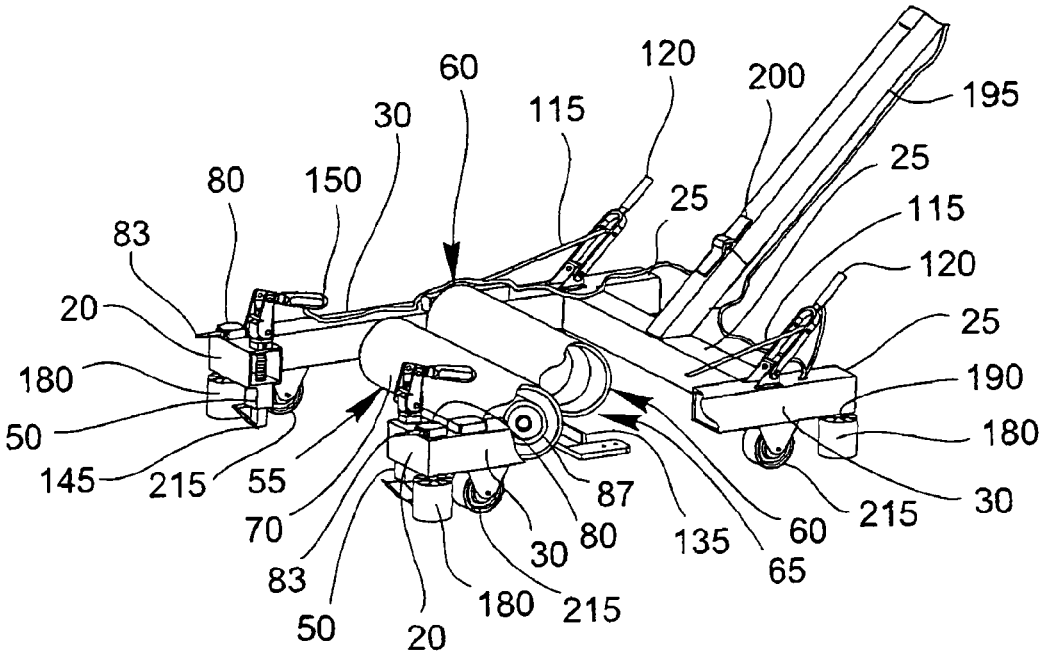
FIG. 6 is another enlarged and partial cutaway view of a portion of the machine with certain components removed for further illustration purposes.

FIG. 6, among the other drawings and descriptions, shows that the outer housing 70 of the motorized drum 55 preferably seals and is rotated by an internally mounted motor and drive or gear train assembly 87 that is mounted to the drive frame 15 by a shaft 85. The shaft 85 is preferably fixed to the drive frame 15 by clamp brackets 90. Such motorized drums 55 are well known to those having knowledge in the relevant fields of technology and are far quieter, have less moving parts, and cost less to use and maintain. For purposes of further example, but not for purposes of limitation, one possibly desirable motorized drum 55 is available from Sparks Belting Company of Grand Rapids, Mich. and is identified as a "DURA-DASH DRIVE™ PLUS" model motorized pulley. Many other possibly suitable motorized drums 55 are also available and are described in more detail in U.S. Pat. Nos. 4,082,180; 3,122,945; and 2,915,167, each of which is incorporated by reference in their entirety as though set forth herein.

As depicted in the figures in one optionally preferred arrangement of the invention, the idler roller 60 rotates freely about a shaft 95 that is carried from the drive frame 15 by an idler adjustor 100 that is adjustably mounted about the drive frame 15. The idler adjustor 100 may be formed as a housing that defines an interior recess sized to capture a biasing element that may be a grip spring 105 that urges the shaft 95 to bias the idler roller 60 to be rotationally coactive with the at least one motorized drum 55.

The idler adjustor 100 also preferably includes at least one grip spring bias adjustor 110 that may be adjusted to optimize the bias force at the grip interface 65 for compatibility with floor coverings FC of varying thicknesses.

Figure 4:
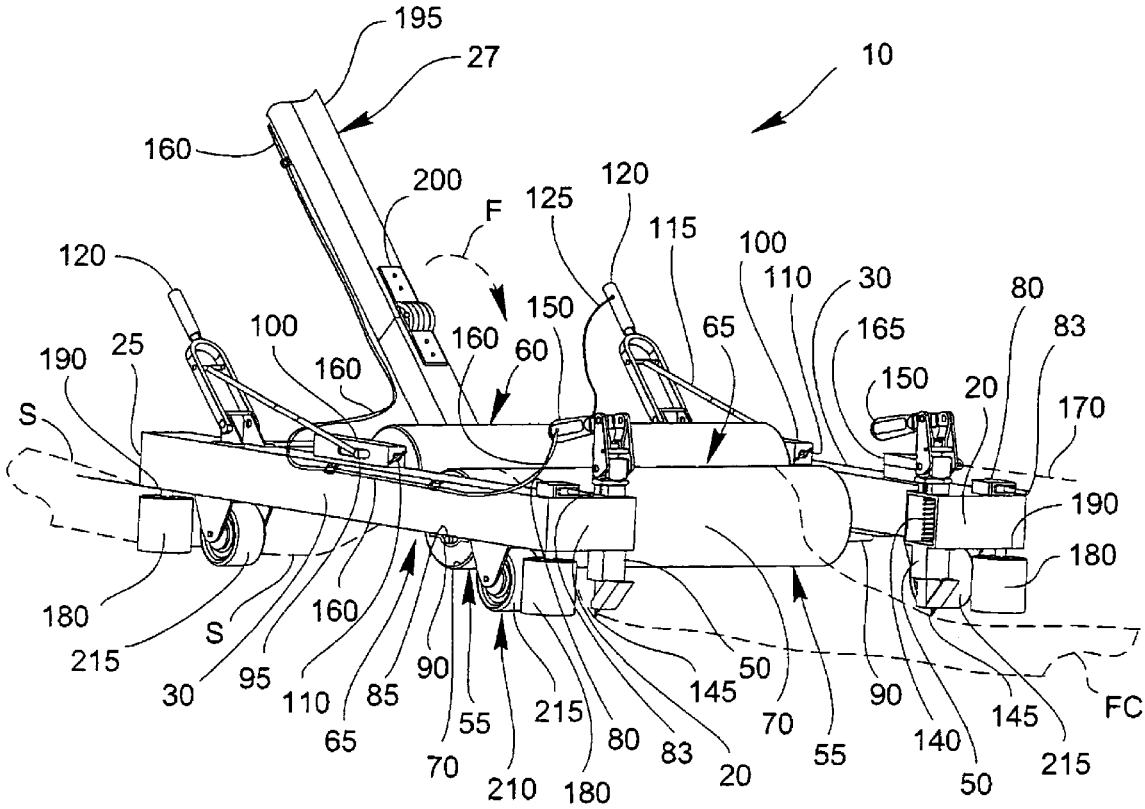
FIG. 4 is an enlarged view of a portion of the machine of the preceding figures, with various components removed for illustration purposes.
Figure 5:
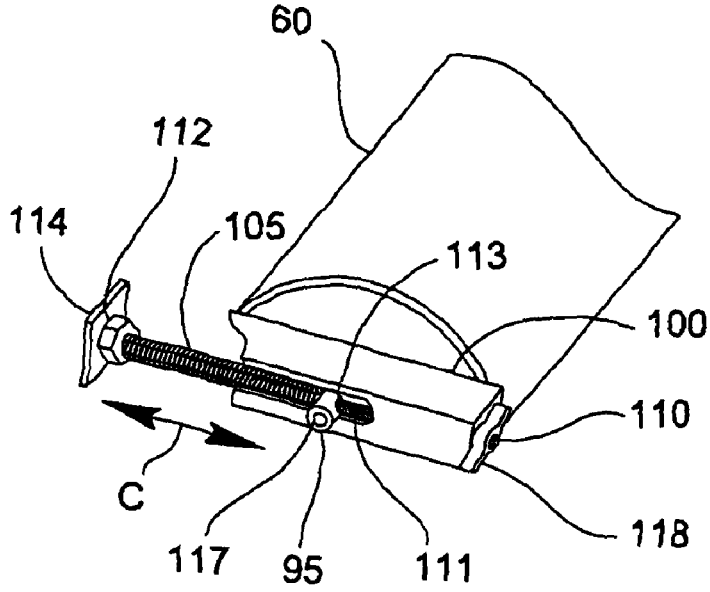
FIG. 5 is an enlarged detailed view of a portion of the machine of the preceding figures, with certain components and structure removed for illustration purposes.

With reference especially to FIGS. 4 and 5, those with knowledge in relevant arts can understand that the idler adjuster 100 captures and mounts the biasing element and or grip spring 105 to the drive frame 15. The idler adjuster 100 also captures and mounts the shaft 95 to the drive frame 15 (See also FIG. 5) in a position whereby the biasing element and or grip spring 105 is biased against the shaft 95 to urge the idler roller 60 against the motorized drum 55 to create the grip and clamp interface 65 therebetween. The selection of the preferred size and force of the grip spring 105 establishes the force with which the idler roller 60 is urged toward and or against the motorized drum 55.

As readily understood by those skilled in the art, as the thickness of the floor covering FC changes, it may be preferable to adjust the bias force of the grip spring 105 by adjusting the grip spring bias adjustor 110. This bias adjustment can be preferred to minimize or eliminate rending of the floor covering FC while optimizing the pulling force available to lift and remove the floor covering FC. For use of the removal machine 10 for lifting and removing floor coverings FC that have increased thicknesses, such as thick pile carpeting, it may be optionally preferred to lessen the gripping or clamping force between the motorized drum 55 and the idler roller 60.

The idler adjuster 100 establishes the capability to change the force without removing and replacing the grip spring 105 (although such replacement is still a possibly preferred option) by actuating bias adjuster 110. With the embodiment of the idler adjuster 100 as shown in FIG. 4, it can be seen that the grip spring bias adjuster 110 may be a threaded shank bolt 111 that can be received with the grip spring 105 against the bolt head 112. The bolt 111 slidably received through an oversized hole 113 on shaft 95, with the spring 105 captured between bolt head 112 and shaft 95.

Preferably, an optional square seat 114 may also be fastened or welded to the bolt head 112 so that the bolt 111 preferably does not turn when received in the housing or when otherwise mounted by the idler adjuster 100. An opposite threaded end of the bolt 111 is slidably received through the oversized hole 113 in shaft 95 as noted, and further projects through the front or feed side of the idler adjuster 100, where it is threaded into the grip spring bias adjuster 110. Although many configurations are contemplated, the bias adjuster 110 also preferably includes a nut, thumb screw, or the wing-type nut 118 illustrated in the Figures, including FIG. 5. Although not shown, a lock nut may also be incorporated.

The clamping force across the grip interface 65 may be increased by tightening the wing-nut 118 against the front or feed side of the idler adjuster 100, which moves the bolt head 112 (and square seat 114) forward in a clamping force direction C (FIG. 5), which compresses the grip spring 105 against the idler roller shaft 95.

The idler roller 60 is moved away from and or separated from the motorized drum 55 by actuation of a link 115 attached at one end to the shaft 95 and at the other end to a release arm 120. The link 115 may be attached to shaft 95 by a shoulder bolt received in a tapped hole 117 in the end of shaft 95. The release arm 120 is mounted to the drive frame 15 to have an over-center range of motion, whereby actuation of the release arm 120 to its maximum extent, toward the ejection side 25 and against a top surface of cutter side 30 enables a self-holding position at the maximum extent. This action pulls link 115 to separate and or move the idler roller 60 away from the motorized drum 55. When the release arm 120 is repositioned, the idler roller 60 is urged by spring 105 and moves towards the motorized drum 55 to clamp the floor covering FC, therebetween across the grip interface 65. The link 115 may be adjustable in length to establish an optional gap across grip interface 65 if needed for use with very thick floor coverings, or for other reasons.

The release arm 120 may be mechanically actuated as contemplated in the various figures and also may be adapted with one or more solenoids or electrical actuation means that can be incorporated remotely in the control assembly 40 and about the release arm 120. Additional variations that any of the preferred embodiments further contemplate remote mechanical actuation by including a release arm lever 130 (FIGS. 1-3) mounted to the control assembly 40 to be connected to the release arm 120 with a sheathed actuation cable 125. For use, the release arm lever 130 is actuated to tension and slidably move the actuation cable 125, which at a distal end is connected to the release arm 120. Movement of the cable 125 thereby remotely actuates the release arm 120.

In further variations of the preferred embodiments of the invention, either or both of the at least one motorized drum 55 and or the at least one idler roller 60 may preferably include their respective outer surfaces to be modified with friction enhancing features. For example, knurling, stippling, and or other finishes and coatings, such as a rubber or other polymeric coatings, may be incorporated to improve the frictional forces imparted by the rotating drum 55 and roller 60. In further variations, the outer surfaces of the drum 55 and the roller 60 may be formed with a replaceable sleeve or other feature that can be replaceable in the event the sleeve becomes unserviceable due to wear and tear or other possible damage resulting from removal operations.

The floor covering removal machine 10 also preferably includes at least one optional scraper 135 (See for example, FIGS. 2, 5) that is positioned to separate the floor covering FC from either the motorized drum 55 and or the idler roller 60. More preferably, the scraper 135 may be fixedly, removably, and or movably carried beneath the drive frame to be urged toward and or against the at least one motorized drum 55 near the grip interface 65 on the side closest to the ejection side 25.

Further, an additional scraper (not shown), such as scraper 135, may be similarly carried from the drive frame proximate to the grip interface 65 and positioned closest to the feed side 20, but which is urged toward and or against the at least one idler roller 60. In this variation, multiple scrapers 135 are thereby adapted to separate the floor covering FC, and any debris or adhesives, from the motorized drum 55 and or the idler roller 60. The scraper 135 is preferably arranged to accommodate the movable relationship of the drum 55 and roller 60, and may be independently movable.

Additional optionally preferred modifications to the embodiments of the floor covering removal machine 10 are directed to the at least one cutter 50 further including a contour following bias spring 140 positioned about and or against the drive frame 15 to urge a blade 145 of the at least one cutter 50 toward a deployed position. More preferably, a toggle plunger type retractor 150 may be mounted to the drive frame 15 to be actuatable against the force of the bias spring 140 to retract the blade 145 of the at least one cutter 50.

In further possibly desirable variations, a retractor 155 may be carried from the control assembly 40 to mechanically actuate the toggle plunger retractor 150 by way of a cable 160 connected therebetween. Even more preferably, the toggle plunger retractor 150 may also be actuatable with one or more solenoids (not shown) in electronic communication with the control assembly 40 in further optional and more automated embodiments. Similar to the operation of the release arm lever 130 and the respective actuation cable 125, operation of the toggle plunger retractor 150 actuates the cable 160 which is at a distal end connected to the toggle plunger retractor 150. In this way, the toggle plunger retractor 150 may be remotely actuated from the guide handle 35.

In further variations of the preferred embodiments of the invention, the described mechanical cables 125, 160 will be replaced with electrical wires that can be used to actuate the additionally contemplated electronic components, such as the solenoids. Additionally, although the various descriptions and figures illustrate only a single release arm cable 125 and the single retractor cable 160, multiple such cables 125 and 160 are contemplated for respective actuation of each of the contemplated respective release arms 120 and the retractors 150.

The contemplated toggle plunger type of retractor 150 may be selected from a number of possibly desirable devices that are often referred to by those skilled in the art as a push/pull action toggle clamp such as that available as part no. 5093A76 from McMaster-Carr of Chicago, Ill. For purposes of further example but not for purposes of limitation, McMaster-Carr also supplies a part no. 5136A15 steel pull action toggle head, which may be readily modified to connect with separator link 115 for use as the over-center release arm 120.

Any of the preferred embodiments of the floor covering removal machine 10 also further contemplate the variations, wherein the drive frame 15 also may preferably include an optional at least one alignment side that may be any one of the at least one cutter sides 30. This optionally preferred modification may further incorporate a laser alignment guide 165 mounted to the at least one alignment side and or the at least one cutter side 30 and includes alignment beam 170.

As may be more preferred in certain applications, the laser alignment guide 165 may be selected from a variety of laser pointers and or laser levels such as the laser level having part no. 21475A63 from McMaster-Carr or the Stanley® device available from Stanley Tool Works, New Britain, Conn., USA, Model 77-152, SP23-N-1 multi-use laser tool, which is adapted to project a laser chalk line or red dot or target point. Each suggested device is well adapted for purposes of the contemplated laser alignment guide 165 according to the present invention.

Figure 7:
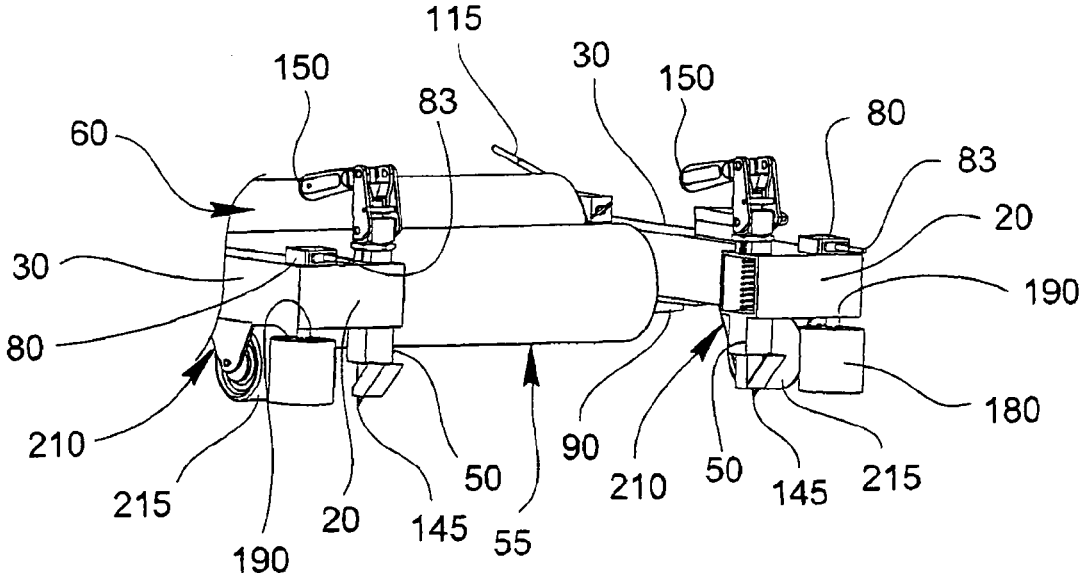
FIG. 7 is an enlarged detail view depicting certain components of the machine for additional description.

In further variations of any of the preceding embodiments, the inventive floor covering removal machine 10 may also further incorporate one or more or a plurality of side rollers 180 that can be mounted to the drive frame 15 about opposite side extents 190 of the feed side 20 and or the opposite ejection side 25, or possibly anywhere about the opposite cutter sides 40 and or alignment sides. With reference now also to FIG. 7, it can be observed that the opposite side extents 190 are preferably defined to be the front corner portions of feed side 20 of the cutter sides 30. For the purposes of further description without limitation, one possibly preferred side roller 180 can be selected to be the model RPA2333 polymeric or urethane roller bearing wheel available from Kornylak Corporation of Hamilton, Ohio, USA.

The present invention also contemplates an improved collapsible profile of the floor cover removal machine 10 that incorporates a foldable knee-bending-type collapsible extension arm 195 connecting guide handle 35 to the drive frame 15, which further includes a releasable bottom hinge 200 and a releasable top hinge 205. When released, the top and the bottom hinges 200, 205 enable the guide handle 35 to be foldable about a superior portion of the drive frame 15 about arrows designated generally by reference letters "F". Further, the releasable bottom hinge 200 may also cooperate with a latch 202 to enable the releasability. Similarly, the releasable top hinge 205 may further cooperate with a top latch 207 for similar releasability.

Any of the preferred and modified embodiments of the invention may also include a skid or caster assembly 210 to enable use, and movement and positioning of the floor covering removal machine 10. More preferably, such a skid or caster assembly 210 may be mounted to an underside of the drive frame 15 and may further include slidable skids (not shown) and or caster wheels 215, or combinations thereof.

The preferred embodiments of the floor covering removal machine 10 and the many possibly preferred variations and modifications thereof, also further contemplate a variety of methods of operation. In one optionally preferred method of operation, the floor covering removal machine 10 is positioned about a floor surface "FS" wherein a portion of the floor covering "FC" has been cut away and lifted to be threaded into the removal machine 10.

More specifically, the at least one idler roller 60 is released and separated and or moved away from the motorized drum 55 by actuation of the release arm 120. Next, a section "S" of the floor covering FC is threaded beneath the drive frame 15 from the feed side 20 over the motorized drum 55, and beneath the idler roller 60 through the grip interface 65, and toward the ejection side 25. The idler roller 60 is then moved by actuation of the release arm 120 in an opposite direction whereby the biasing element and or grip spring 105 urges the idler roller 60 toward and or against the motorized drum 55 to grip the floor covering FC in the grip interface 65.

With the section S of the floor covering FC threaded into the grip interface 65, the removal machine 10 is ready for lifting and removal of the floor covering FC. As those skilled in the art can comprehend, although the various figures and illustrations describe the motorized drum 55 to be generally beneath and in front of the idler roller 60, other variations of the inventive removal machine 10 contemplate equally useful and optionally preferred configurations, wherein the position of the drum 55 and the roller 60 may be reversed or otherwise rearranged in alternative adaptations of the removal machine 10.

In the various configurations of the removal machine 10 described in the figures and elsewhere herein, the motorized drum 55, when threaded with the floor covering FC and strip or section S across the grip interface 65, drives the idler roller 60 in a counter-rotating direction. Although not required for most embodiments and applications of the removal machine 10, additional optionally desirable configurations are available, wherein the idler roller 60 is replaced with a second motorized drum 55 positioned to cooperate with and or in place of the idler roller 60 so as to establish even greater power available for the lifting and removal operation.

In continued operation of the floor covering removal machine 10, and after the floor covering FC has been threaded into the grip interface 65, the motor speed control 45 is adjusted to convey the floor covering FC and section S from the feed side 20 of the grip interface 65 toward the ejection side 25 so as to lift the floor covering FC from the floor surface FS and to eject the lifted and removed floor covering strip or section S.

The at least one cutter 50 is deployed to the floor surface FS (FIG. 3) so as to cut the floor covering FC into strips during the operation of the machine 10. More preferably, a second at least one cutter 50 is also deployed to the floor surface FS so that both cutters cooperate to cut a section S of the floor covering FC into a strip "S" that is sized for conveyance through the grip interface 65. During the lifting and removal operation, the guide handle 35 is grasped to maneuver the removal machine 10 as it is being pulled by the motorized drum 55, which is conveying the floor covering FC and lifted section S through the grip interface 65.

As the floor covering removal machine 10 completes the lifting and removal operation of a section S of the floor covering FC, the at least one motorized drum 55 may be stopped either by actuation of the motor speed control 45, or by actuation of the at least one limit switch or cutoff switch 80, which is depressed as the removal machine 10 approaches a wall or other vertically projecting appurtenance. In the applications where the floor covering FC has been completely removed from the floor surface FS so that floor covering section S has been conveyed completely through the grip interface 65, the machine 10 may simply be repositioned to another location for continued removal of additional sections S of the floor covering FC.

However, in an alternative use where the motorized drum 55 has been stopped by actuation of the motor speed control 55, and before a complete strip or section S of the floor covering FC has been removed, it may be preferred to cut away a section of the floor covering FC so that the strip or section S that has been used may be unthreaded from the grip interface 65 for repositioning of the machine 10.

In alternative variations of this method, the motor speed control 45 and the selector 75 may be adjusted to reverse the direction of the at least one motorized drum 55 and the at least one idler roller 60 so as to unthread the section S of the floor covering FC from the grip interface 65. In this alternative method, the release arms 120 may not be needed.

In this optional scenario where only a portion of a floor covering FC has been removed, the motorized drum 55 is stopped, the portion of the floor covering section immediately proximate to the feed side 20 of the machine is cut from the remaining portion of the unremoved floor covering FC. The release arm 120 is actuated to separate and or move the idler roller 60 away from the motorized drum 55, and the floor covering strip S is removed from the grip interface 65.

The floor covering removal machine 10 may then be repositioned elsewhere for continued use. More preferably, the at least one cutters 50 are typically retracted, after the motorized drum 55 is stopped, by actuation of the toggle plunger retractors 150. In this way, the unlifted or unremoved portions of floor covering FC are not unnecessarily rended by the at least one cutter 50 during repositioning of the floor covering removal machine 10.

During actual lifting and removal operations, the motor speed control 45 is preferably adjusted to control the rotation of the motorized drum 55 so that the floor covering FC is not rended by the conveyance force of the rotating motorized drum 55 as it is lifted from the floor surface FS and through the grip interface 65.

Those with skill in the art can appreciate in view of the preceding description that the inventive floor covering removal machine 10 has a reduced physical profile and a footprint that is far smaller than prior art devices, yet which contains optimized maneuverability and maximized available force for lifting and removing floor coverings FC such as carpeting. This is a direct result of the innovative arrangement of the drive frame 15 and the collapsible guide handle 35. Additionally, with use of the motorized high-torque drum 55 and the idler roller 60 for pulling up the floor covering FC, a minimum amount of complexity and the number of moving parts is needed, which in turn minimizes the weight of the novel removal machine 10. Further advantages of the incorporated motorized drum 55, include a far quieter operation than has been previously possible in the prior art due to the internal motor and drive train 87 that is sealed within the outer housing 70. These features of the present invention, when further combined with the speed selector 75 and the motor speed control unit 45, enable fully adjustable speed settings of the motorized drum 55, which more effectively and flexibly adjusts the force imparted during the lifting and removal of the floor covering FC to further minimize dust, rending, and debris.

The floor covering removal machine 10 in any of its various optionally preferred configurations may also be used during operation to remove and cut generally equal width strips S of the floor covering FC by further use of the optional laser alignment guide 165. More particularly, the guide handle 35 is maneuvered during operation to align the projected beam 170 with remote target point on a distal wall, whereby the deployed at least one cutter or cutters 50 may thereby cut substantially constant width sections S of the floor covering FC. Alternatively, the optional laser alignment guide 165 is employed whereby the projected beam 170 paints a chalk-line-like beam along the floor covering FC. This enables maneuvering of the guide handle 35 with reference to the beam 170 so that the floor covering removal machine 10 cuts substantially uniform sections S of the floor covering FC during the removal operation.

In further applications and methods for use of the innovative floor covering removal machine 10, those having skill in the art can comprehend that the removal machine 10 is capable of self-propulsion even when not being used in a floor covering removal mode. More specifically, for further improvement over the state of the art, the removal machine 10 can be operated whereby the drive roller or motorized drum 55 is actuated in a slow speed and reverse mode of operation, and to have the motorized drum 55 resting against a ramp surface (not shown). In this way, the floor covering removal machine 10 can be self-propelled up a ramp and into a transport vehicle without the need for lifting. Further variations of the self-propelled method of operation of the removal machine 10 include reverse direction operation of the motorized drum 55 in a slow speed mode with the guide handle 35 folded to lower the profile of the removal machine 10 for loading and transport in smaller vehicles.

Figure 8:
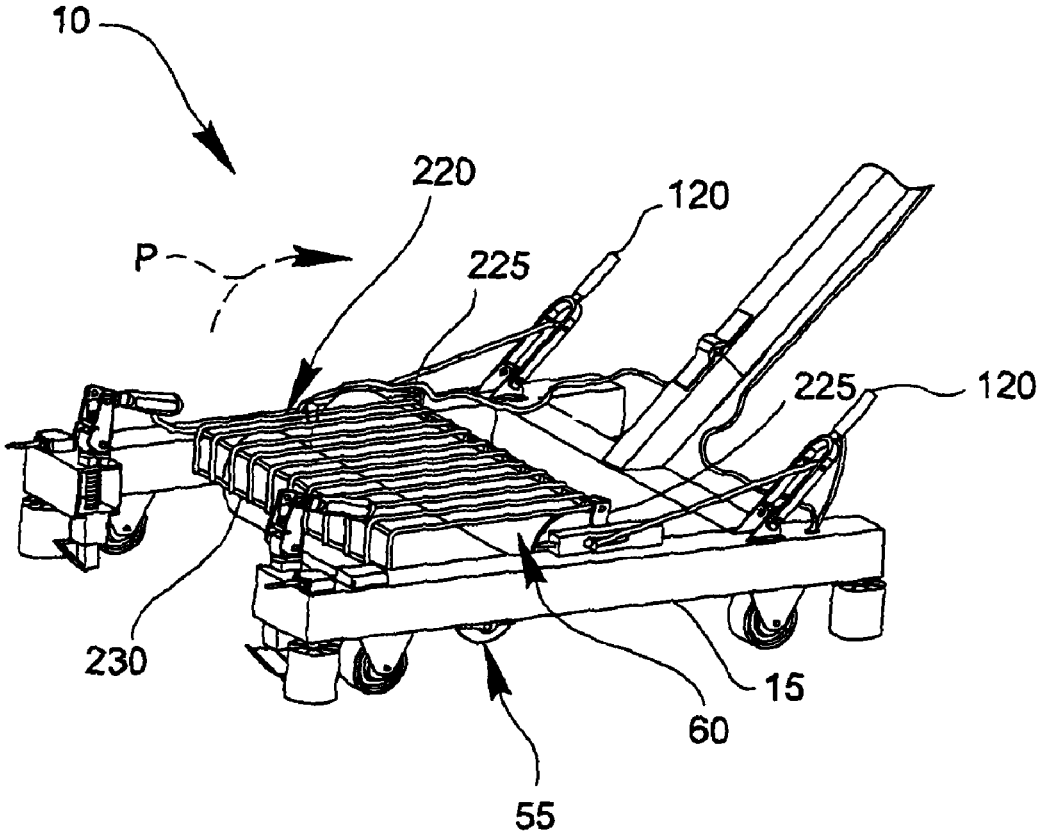
FIG. 8 is a top perspective view of another variation of the invention.

With reference now to FIG. 8, it can be further observed that additional embodiments of the invention may preferably include a grip interface guard 220 carried from the drive frame 15 about mount brackets 225. In further variations, the grip interface guard 220 may be hingeably or pivotably carried from the mount brackets 225, to be movable in the direction generally depicted by pivot direction arrow P (FIG. 8). This arrangement can improve access to the motorized drum 55, the idler roller 60, as well as the grip interface 65. More preferably, the grip interface guard 220 may also incorporate a debris deflector portion 230 that may be arranged to project inferiorly deflect debris from reaching the grip interface 65 as the floor covering FC is conveyed therethrough. Even more preferably, the grip interface guard 220 is removable and replaceable for use when preferred.

Although the present invention has been described in detail in connection with the discussed embodiments, various modifications may be made by one of ordinary skill in the art without departing from the spirit and scope of the present invention. Therefore, the scope of the present invention must be determined by the attached claims.

The invention claimed is:

1. A floor covering removal machine, comprising:

a drive frame including a feed side, an ejection side, and at least one cutter side;

a guide handle extending from the drive frame;

a control assembly with a motor speed control coacting with the drive frame;

at least one motorized drum carried from the drive frame and in electrical communication with the motor speed control, said motorized drum including a cylindrical outer housing rotationally driven by an internal motor and gear train assembly; and at least one releasable idler roller rotationally coactive with the at least one motorized drum to establish a grip interface to be received with the floor covering when being conveyed from the feed side to the ejection side.

2. The floor covering removal machine according to claim 1 wherein the motor speed control includes a reverse, constant, and adjustable speed selector.

3. The floor covering removal machine according to claim 2, wherein the motor speed control includes an alternating current frequency controller for switching between a single phase current to a three phase current and a delay circuit to gradually adjust the speed of the motorized drum.

4. The floor covering removal machine according to claim 1, further comprising:

at least one actuatable limit switch carried from the feed side and in electrical communication with the motor speed control to stop the at least one motorized drum upon actuation.

5. The floor covering removal machine according to claim 1, further comprising:

a biasing element carried about the drive frame to urge the at least one idler roller to rotationally coact with the at least one motorized drum; and a release arm carried from the drive frame and connected to the at least one idler roller, the release arm movable to an unclamped position moving the at least one idler roller away from the motorized drum.

6. The floor covering removal machine according to claim 5, further comprising:

at least one retractable floor covering cutter deployable beneath the drive frame about the at least one cutter side.

7. The floor covering removal machine according to claim 6, wherein the at least one cutter includes a contour following bias spring urging the cutter toward the deployed position.

8. The floor covering removal machine according to claim 1, further comprising:

a scraper carried beneath the drive frame and urged against the at least one motorized drum.

9. The floor covering removal machine according to claim 1, further comprising:

a retractor mounted about the guide handle and connected to the at least one cutter.

10. The floor covering removal machine according to claim 1, further comprising:

the drive frame including at least one alignment side; and a laser alignment guide mounted to the at least one guide side and including a projected alignment beam.

11. The floor covering removal machine according to claim 1, further comprising:

at least one of side roller about an outside extent of the feed side.

12. A floor covering removal machine, comprising:

a drive frame including an underside caster assembly and a feed side, an ejection side, and cutter sides arranged about opposite extents of the feed side;

a control assembly having a motor speed control and coacting with the drive frame;

at least one retractable floor covering cutter deployable beneath the drive frame about respective cutter side, the cutter including a contour following bias spring urging the cutter toward the deployed position;

at least one motorized drum carried from the drive frame and in electrical communication with the motor speed control, said motorized drum including a cylindrical outer housing rotationally driven by an internal motor and gear train assembly; and at least one releasable idler roller rotationally coactive with the at least one motorized drum to establish a grip interface to be received with the floor covering when being conveyed from the feed side to the ejection side.

13. The floor covering removal machine according to claim 12, further comprising:

at least one actuatable limit switch spaced apart and carried from the feed side and in electrical communication with the motor speed control to stop the motorized drum upon actuation.

14. The floor covering removal machine according to claim 12, further comprising:

a biasing element carried about the drive frame to urge the at least one idler roller to rotationally coact with the at least one motorized drum; and a release arm carried from the drive frame and connected to the idler roller, the release arm movable to an unclamped position moving the at least one idler roller away from the motorized drum.

15. The floor covering removal machine according to claim 12, further comprising:

a scraper carried beneath the drive frame and urged against the drum roller proximate to an ejection side of the grip interface to separate the floor covering from the motorized drum.

16. The floor covering removal machine according to claim 12, further comprising:

the drive frame including at least one alignment side; and a laser alignment guide mounted to the at least one guide side and including a projected alignment beam.

17. The floor covering removal machine according to claim 12, further comprising:

at least one side rollers about an outside extent of the feed side.

18. The floor covering removal machine according to claim 12, wherein the motor speed control includes an alternating current frequency controller for switching between a single phase current to a three phase current and a delay circuit to adjust the speed of the motorized drum.

19. A method for removing a portion of a floor covering bonded to a floor surface using a means for lifting and removing the floor covering that includes a drive frame with a feed side, an ejection side, and at least one cutter side; a control assembly having a motor speed control coacting with the drive frame; at least one motorized drum carried from the drive frame and in electrical communication with the motor speed control wherein said motorized drum includes a cylindrical outer housing rotationally driven by an internal motor and gear train assembly; and at least one idler roller rotationally coactive with the at least one motorized drum to establish a grip interface to be received with the floor covering when being conveyed from the feed side to the ejection side;

the method including the steps of:

threading a floor covering from the feed side through the grip interface toward the ejection side;

conveying the floor covering section from the feed side through the grip interface toward the ejection side;

maneuvering the machine as it is pulled by the floor covering being conveyed through the grip interface;

stopping the motorized drum; and removing the lifted floor covering from the grip interface.

20. The method for removing a portion of a floor covering according to claim 19, further comprising the steps of:

releasing the at least one idler roller and separating it from the motorized drum before the threading step;

moving the idler roller to grip the floor covering against the motorized drum after the threading step;

deploying at least one cutter before conveying the floor covering section;

retracting the at least one cutter after the step of stopping the motorized drum; and releasing the at least one idler roller and removing the lifted floor covering.

* * * * *